US008550290B1

(12) United States Patent
Davis

(10) Patent No.: US 8,550,290 B1
(45) Date of Patent: Oct. 8, 2013

(54) PORTABLE STORAGE SYSTEM COMPRISING A MEANS FOR ADJUSTABLE VENTILATION

(76) Inventor: Robert L. Davis, Rochester, NY (US)

( * ) Notice: Subject to any disclaimer, the term of this patent is extended or adjusted under 35 U.S.C. 154(b) by 0 days.

(21) Appl. No.: 13/533,767

(22) Filed: Jun. 26, 2012

(51) Int. Cl.
*B65D 90/34* (2006.01)
*A47J 47/14* (2006.01)

(52) U.S. Cl.
USPC ..... 220/745; 220/367.1; 220/366.1; 220/676; 206/550; 206/541; 206/223; 454/183; 454/177; 454/250; 217/42

(58) Field of Classification Search
USPC ..... 220/745, 367.1, 366.1, 676, DIG. 27; 206/550, 541, 223; 454/183, 237, 250, 454/904, 177; 217/42
See application file for complete search history.

(56) References Cited

U.S. PATENT DOCUMENTS

| | | | | | |
|---|---|---|---|---|---|
| 634,132 | A | * | 10/1899 | Gilmore | 220/8 |
| 640,933 | A | * | 1/1900 | Osborne | 206/550 |
| 1,142,932 | A | * | 6/1915 | Clark | 206/541 |
| 1,324,891 | A | * | 12/1919 | Greenstreet | 206/550 |
| 1,346,034 | A | * | 7/1920 | Kelso | 206/550 |
| 1,580,440 | A | * | 4/1926 | Lewis | 206/550 |
| 2,255,503 | A | * | 9/1941 | Carbary | 454/183 |
| 2,287,312 | A | * | 6/1942 | Kader | 206/541 |
| 2,783,874 | A | * | 3/1957 | Brown et al. | 206/543 |
| 5,513,580 | A | | 5/1996 | Franks | |
| 5,564,975 | A | * | 10/1996 | Northcutt | 454/298 |
| 6,105,844 | A | * | 8/2000 | Walters et al. | 224/610 |
| 6,367,651 | B2 | | 4/2002 | Laib et al. | |
| 7,152,419 | B1 | * | 12/2006 | Armour et al. | 62/187 |
| 7,334,684 | B1 | * | 2/2008 | Fontanilla et al. | 206/541 |
| 7,357,272 | B2 | | 4/2008 | Maxwell | |
| 7,731,308 | B1 | | 6/2010 | Riemer | |
| 2002/0069599 | A1 | * | 6/2002 | Dhallan | 52/302.1 |
| 2005/0082305 | A1 | | 4/2005 | Dais et al. | |
| 2007/0246495 | A1 | | 10/2007 | Hague | |
| 2009/0191022 | A1 | | 7/2009 | Meiser et al. | |
| 2010/0176022 | A1 | | 7/2010 | Furlong | |
| 2011/0180543 | A1 | | 7/2011 | Rusnak et al. | |

* cited by examiner

*Primary Examiner* — Mickey Yu
*Assistant Examiner* — Gideon Weinerth
(74) *Attorney, Agent, or Firm* — Tracy Jong Law Firm; Cheng Ning Jong; Louis Reale

(57) ABSTRACT

A storage container system comprising an arrangement for adjustable ventilation intended for storing at least one article that is thermally sensitive and/or requires ventilation to the ambient atmosphere. The device includes at least one door and at least one aperture ventilation assembly. The aperture ventilation assembly includes a planar wall aperture array and a corresponding planar shutter aperture array, wherein the sliding relationship between the two arrays results in a plurality of ventilation levels, including a fully open state, and a closed state capable of substantially sealing off the contents of the container from the ambient atmosphere. Certain preferred embodiments include a plurality of storage compartments configured within the container's inner volume wherein each compartment is sealed from one another and possesses its own aperture ventilation assembly for ventilation adjustments.

18 Claims, 10 Drawing Sheets

PORTABLE STORAGE SYSTEM COMPRISING A MEANS FOR ADJUSTABLE VENTILATION

FIELD OF THE INVENTION

This invention generally relates to storage containers primarily directed to the safekeeping of thermally sensitive materials and/or materials requiring cold storage and/or ventilation, e.g. food, medication, and the like. In a more specific aspect, the present invention primarily relates to a portable storage system comprising a means for adjustable ventilation with respect to the ambient atmosphere surrounding the portable storage container.

BACKGROUND OF THE INVENTION

Storage containers for the purpose of storing medicines, holding foods and the like, under a variety of temperature conditions are known in the art. For example, U.S. Pat. No. 6,367,651 (to Laib et al.), U.S. Pat. No. 7,357,272 (to Maxwell), U.S. Pat. Pub. No. 2005/0082305 (to Dais et al.), U.S. Pat. Pub. No. 2010/0176022 (to Furlong), U.S. Pat. Pub. No. 2011/0180543 (to Rusnak et al.), and U.S. Pat. Pub. No. 2009/0191022 (to Meiser et al.), all generally describe storage containers having some type of aperture, hole, or vent. The vents in the aforementioned references are vents provided to function as gas-exchange ports (e.g. oxygen exchange), and possess relatively small openings. Such small openings are not capable of providing a rapid thermal equalization with the environment surrounding the container, where the inside temperature of the container equals that of the immediate environment is the goal. Such a rapid thermal equalization requires substantially large ventilation openings that allow substantial air flow, not taught by the aforementioned references.

U.S. Pat. Pub. No. 2009/0191022 (to Meiser et al.) teaches a lockable container (to prevent unauthorized intrusion) including a ventilation scheme is not adjustable. The remaining aforementioned references disclose containers that possess some sort of adjustable ventilation scheme, but do not lend themselves to intrusion locking.

None of the aforementioned references teach a container system that can be constructed from thermally insulative materials (typically rigid materials over ¼ inch thick), and still perform their intended function. Furthermore, the corresponding adjustable ventilation schemes could not be constructed from said thermally insulative materials due to the incompatibility between the nature of the adjustable ventilation designs and the material properties of typical thermally insulative type materials.

Accordingly, in view of the foregoing deficiencies among other shortcomings, there exists a clear motivation in the storage container arts for new and useful improvements.

SUMMARY OF THE INVENTION

The present invention generally relates to a portable storage container having a means for manually adjustable ventilation. The storage container includes at least one door and at least one aperture ventilation assembly. The aperture ventilation assembly includes a wall aperture array and a corresponding shutter aperture array located on a shutter member, both possessing a planar geometry, wherein the sliding relationship between the two arrays results in a plurality of ventilation levels, including a fully open state, and a closed state capable of substantially sealing off the contents of the container from the ambient atmosphere. Certain preferred embodiments, from the conceivable many, further include a plurality of storage compartments configured within the container's inner volume wherein each compartment is sealed from each other and possesses its own aperture ventilation assembly enabling discrete ventilation adjustments.

In the storage arts, rectangular type container structures are best known for storage efficiency, and therefore, is the primary focus of the present invention. It is not the intention of the present invention to teach away from the utilization of containers having geometries other than rectangular. Exemplary nonrectangular containers geometries include, but not limited to: spheres, cylinders, and conic sections.

Accordingly, it is an object of the present invention to provide a user friendly portable storage container having at least one aperture ventilation assembly that enables rapid thermal equalization of the container's storage area with the ambient atmosphere or environment.

It is another object of the present invention to provide a portable storage container substantially fabricated from a thermally insulative, rigid material such that when the container's aperture ventilation assemblies are in the closed state, the container's inner storage volume is thermally isolated from the ambient atmosphere, thereby performing the function of an ordinary cooler. Additionally, the aperture ventilation assembly will be configured from such a thermally insulative, rigid material so to not introduce any substantial thermal leaks in the storage container's structure when the ventilation assemblies are in the closed state (no ventilation).

It is another object of the present invention directed to certain preferred embodiments from the conceivable many, wherein the portable storage container includes a lockable hingedly connected door with limited range of motion so that the door provides a temporary shelf when the door is in the open position.

It is yet another object of the present invention directed to certain preferred embodiments from the conceivable many, wherein the portable storage container includes a lockable hingedly connected door so to prevent unauthorized access to the contents stored in the unit's inner storage volume.

It is yet another object of the present invention directed to certain preferred embodiments from the conceivable many, wherein the portable storage container includes an external control for positioning the shutter member(s) so that a user can adjust the ventilation level when the portable storage container is in the closed door or closed door locked position.

It is yet another object of this invention to provide a relatively simple device that is economical from the viewpoint of the manufacturer and consumer, is susceptible to low manufacturing costs with regard to labor and materials, and which accordingly evokes low prices for the consuming public, thereby making it economically available to the buying public.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

PARTICULAR ADVANTAGES OF THE INVENTION

The present invention provides a simple, cost-effective, efficient solution directed to a portable storage type containers having a means for manually adjustable ventilation. Multi-compartment containers can be configured such that each compartment possesses its own ventilation control system.

One focus of the present invention is to provide a user the ability to select the best storage condition for a given item or variety of items contained in the one or more storage compartments. Given a lunchbox type embodiment of the present invention having an upper thermos compartment, a lower left compartment, and a lower right compartment, wherein each compartment has its own ventilation control system; a user can customize the ventilation level or magnitude of each compartment to the optimum storage condition of the contents contained therein. For example, given a 40 deg. F., environment (e.g. a tent or an automobile passenger compartment on a cool day), a tuna sandwich can be placed in the lower left compartment with the ventilation level set fully open to take advantage of the cool temperature of the ambient atmosphere or environment; fruit can be stored in the lower right compartment with the ventilation level set to a partially open to allow respiration without undue dehydration; and a thermos containing a hot beverage can be stored in a vent-less state in the upper thermos compartment for enhanced thermal storage. Additionally, if the unit is accessible to others, a door lock can protect contents from unauthorized access without interfering with set ventilation levels.

Additional advantages of the present invention pertain to situations where thermally sensitive materials (medications, medically treated foods, mother's milk, and the like) have to be transported from one thermally controlled environment to another (e.g. presently utilized refrigerator to destination refrigerator). A portable storage container of the present invention, in the locked condition, with the ventilation level set fully open position is located in the presently utilized refrigerator (refrigerator-A). The container can then be removed from refrigerator-A, and the ventilation level can then be positioned to the closed state via an external shutter member control knob, substantially sealing off contents from the warm ambient atmosphere. The container, now acting as a simple cooler, can be safely transported to the destination refrigerator (refrigerator-B), where the ventilation level is returned to the fully open position just prior to placement in refrigerator-B. The contents stored in the portable storage container are thermally managed while simultaneously protected from unauthorized access. Ventilation adjustments while maintaining secure storage for the contents yields several benefits, including: the user/owner can bypass the effort required to unlock the container for ventilation adjustments, a courier can be instructed to adjust ventilation level without having access to contents-valuable in medication transports, and so forth.

BRIEF DESCRIPTION OF THE DRAWINGS

The ensuing detailed description section makes reference to the annexed drawings. An enhanced understanding of the present invention will become evident when consideration is given to the detailed description thereof and objects other than the aforementioned become apparent. The invention will be described by reference to the specification and the annexed drawings, in which like numerals refer to like elements, and wherein.

Figure 1:
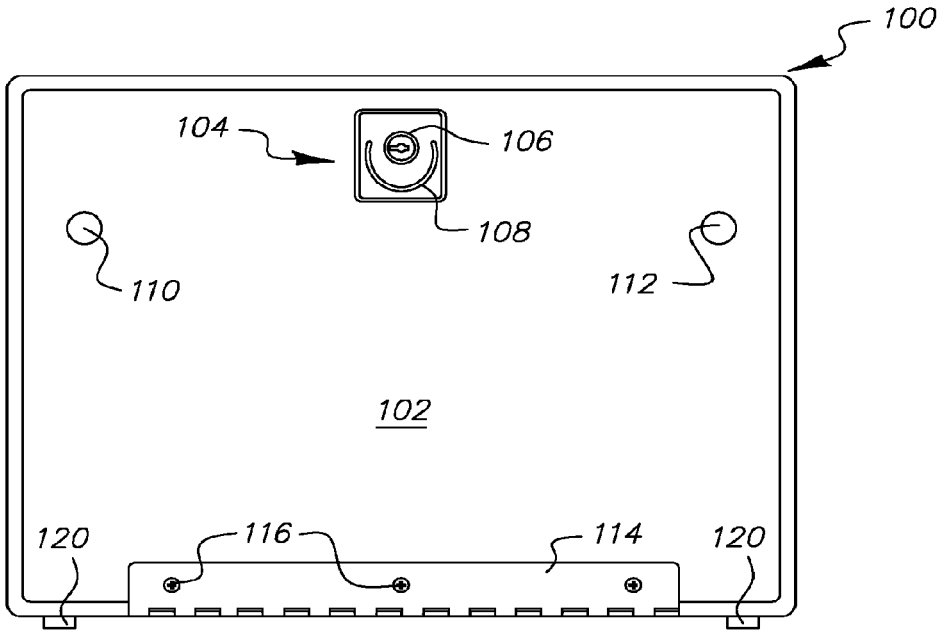
FIG. 1 illustrates an front orthogonal view of an exemplary portable storage container 100, with the hingedly connected door in the closed state.

The drawings are not to scale, in fact, some aspects have been emphasized for a better illustration and understanding of the written description.

DEFINITIONS AND CONVENTIONS USED IN THIS SPECIFICATION

The portable storage system comprising a means for adjustable ventilation or portable storage container discussed throughout this disclosure shall have equivalent nomenclature, including the container, the device, the unit, the apparatus, the present invention, or the invention. Additionally, the term "exemplary" shall possess a single meaning throughout this disclosure; wherein the sole definition pertains to serving as an example, instance, or illustration.

It must be noted that as used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprising", "including", "characterized by", "possessing" and "having" are all understood to function as open-ended transition terms that can be used interchangeably.

The term magnetic fastening material is understood to include and define magnets as well as any solid material that is attracted to a magnet, including iron, steel, and the like. Such magnetic fastening materials properly combined, provide an impermanent fastening means that continuously provides engagement forces utilized in components requiring a holding, latching, and sliding frictional engagement type of relationships.

To help facilitate disclosure understanding and streamline the location of figures and associated part numbers, a systematic parts/features numbering convention has been employed. The first digit in three digit part numbers refers to the figure number where the part was first introduced, or is best depicted. Likewise, in four digit part numbers, the first two digits refer to the figure number where the part was first introduced, or is best depicted. Although this disclosure may at times deviate from this convention, it is the intention of this numbering convention to enable expeditious comprehension of the disclosure.

PARTS/FEATURES LIST

100. portable storage container (door in the closed state)
102. door (front wall)—hingedly connected
104. lock/handle assembly
106. lock
108. handle
110. holding magnet (left side)
112. holding magnet (right side)
114. continuous hinge (piano hinge)
116. fasteners (screws)
120. feet
200. portable storage container (door in the open state)
202. door travel limiters
204. retractor cable assembly
205. retractor cable
206. locking arm
208. strike plate
210. inner storage volume
212. top wall
214. back wall
216. bottom wall
218. left side wall
220. right side wall
222. door fastener(s)
224. right shutter member
226. left shutter member
300. storage volume detail (right portion of unit)
302. wall aperture(s), (right side)
304. wall aperture array, (right side)
306. wall magnetic fastening material, rear member (second magnetic fastening material)
308. wall magnetic fastening material, front member (second magnetic fastening material)
400. right shutter member
402. right shutter aperture(s)
404. right shutter aperture array
406*a*. shutter magnetic fastening material
406*b*. shutter magnetic fastening material
408*a*. shutter magnetic fastening material
408*b*. shutter magnetic fastening material
500. right wall aperture ventilation assembly (internal view)
502. user
600. left wall aperture ventilation assembly (external view with ventilation level in the fully open state)
602. wall aperture(s), (left side)
603. wall aperture array, (left side)
604. external shutter control assembly
606. control knob (for external shutter member)
608. control knob slot
610. airflow (maximum level)
612. shoulder strap assembly
700. portable storage container left side (ventilation level in the partially open state)
702. airflow (reduced level)
800. portable storage container left side (ventilation level in the closed state)
802. airflow (no airflow-sealed)
900. fully open ventilation level (wall aperture 602 and left shutter aperture are in alignment)
1000. partially open ventilation level (wall aperture 602 and left shutter aperture are in partial alignment)
1100. closed ventilation level (wall aperture 602 and left shutter aperture are not in alignment—substantially sealed condition)
1200. storage volume detail (inner storage volume single shelf support system)
1202. back wall shelf support member (upper shelf)
1204. side wall shelf support member (upper shelf)
1300. double shelf support system
1302. back wall shelf support member (lower shelf)
1304. side wall shelf support member (lower shelf)
1306. lower shelf
1400. multi-compartment portable storage container
1402. lid (hingedly connected to body 1404)
1404. body
1406. lock assembly (key access)
1406*a*. latching arm (spring loaded)
1406*b*. strike plate

1406*c*. latching arm release
1406*d*. key hole
1408. left compartment wall aperture array
1410. external shutter control assembly (left)
1412. right compartment wall aperture array
1414. external shutter control assembly (right)
1500. multi-compartment portable storage container
1502. lid bottom wall (for lid inner storage volume)
1504. separation wall
1506. left shutter member
1508. right shutter member
1510. lid inner storage volume
1512. thermos
1514. left compartment inner storage volume
1516. right compartment inner storage volume
1600. pair of shutter members
1602. left shutter magnetic fastening material
1604. left shutter magnetic fastening material
1606. left shutter aperture
1608. left shutter aperture array
1610. control knob—left external shutter member
1612. right shutter magnetic fastening material
1614. right shutter magnetic fastening material
1616. right shutter aperture
1618. right shutter aperture array
1620. control knob—right external shutter member
1700. refrigerator appliance (portable storage container 100 stored within)
1702. key (for lock/handle assembly 104)
1704. ambient atmosphere (surrounding portable storage container 100)

DETAILED DESCRIPTION

With reference to the drawings of the present invention, several embodiments pertaining to the communication system and method of use thereof will be described. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Terminology of similar import other than the words specifically mentioned above likewise is to be considered as being used for purposes of convenience rather than in any limiting sense.

In this context, the portable storage container having a means for manually adjustable ventilation may be constructed from a variety of durable materials. Preferred embodiments, are substantially fabricated from thermally insulative, rigid type materials so that the portable storage container's inner storage volume is thermally isolated from the ambient atmosphere when the container's ventilation level is in the closed state. Exemplary preferred class of materials is available from Coastal Enterprises located at 1925 West Collins Ave., Orange, Calif., 92863-4875. The materials are available in sheet form and classes include low temp polyurethane precision boards as well as Precision Board Plus PBLT—made with Green "eco-friendly" urethane components. These durable materials possess a closed cell structure to prevent absorption, possess excellent thermal insulation properties, and are easily cut or machined with standard cutting tools.

Plastic materials suitable for use in the construction of the device are those normally solid, organic polymers that are readily shaped or molded or otherwise fabricated into the desired container form and possess sufficient rigidity.

Preferably, the polymers are thermoplastic and are relatively inert to those materials which are to be stored or contained within the unit. Because of their low cost and superior structural properties, polymers used in structural applications, so-called engineering plastics, present a logical material choice. Preferred polymers include: polystyrene, styrene/acrylonitrile copolymers, styrene/butadiene copolymers, styrene/butadiene/acrylonitrile copolymers, rubber modified styrene polymers, and other polymers of monovinylidene aromatic carbocyclic monomers are generally preferred. Other polymers which may be suitably employed are acetal plastics such as polyformaldehyde resin, polyolefins such as polyformaldehyde resin, polyolefins such as amides, such as nylon, rigid polyvinyl chloride, polyesters such as poly(ethylene terephthalate) acrylic resins such as poly(methyl methacrylate), and the like. The polymers, among others, can be formed into the desired shape by conventional forming techniques, e.g., blow molding, extrusion, rotational molding, and injection molding.

It is understood that material selection considerations are dependent on a variety of factors, including: compatibility with the items to be stored, attributes of user(s), method of transportation (e.g. manual transport, hand-cart, automobile), compatibility expected environmental conditions, device cost considerations, and the like.

FIG. 1 illustrates a front orthogonal view of an exemplary portable storage container 100 with the hingedly connected door 102 in the closed state. Lock/handle assembly 104 is located on the top center portion of door 102, and includes lock 106, and handle 108 for opening door 102. Lock 106 is controlled by key 1702 (depicted in FIG. 17) and controls locking arm 206 (depicted in FIG. 2) which impermanently engages strike plate 208 at the discretion of the user(s) providing locked and unlocked states for door 102. The bottom edge portion of door 102 is fastened to the upper portion of continuous hinge (piano hinge) 114 by fasteners (screws) 116; whereas the lower portion of continuous hinge (piano hinge) 114 is fastened to the front edge of bottom wall 216 in like manner.

Figure 17:
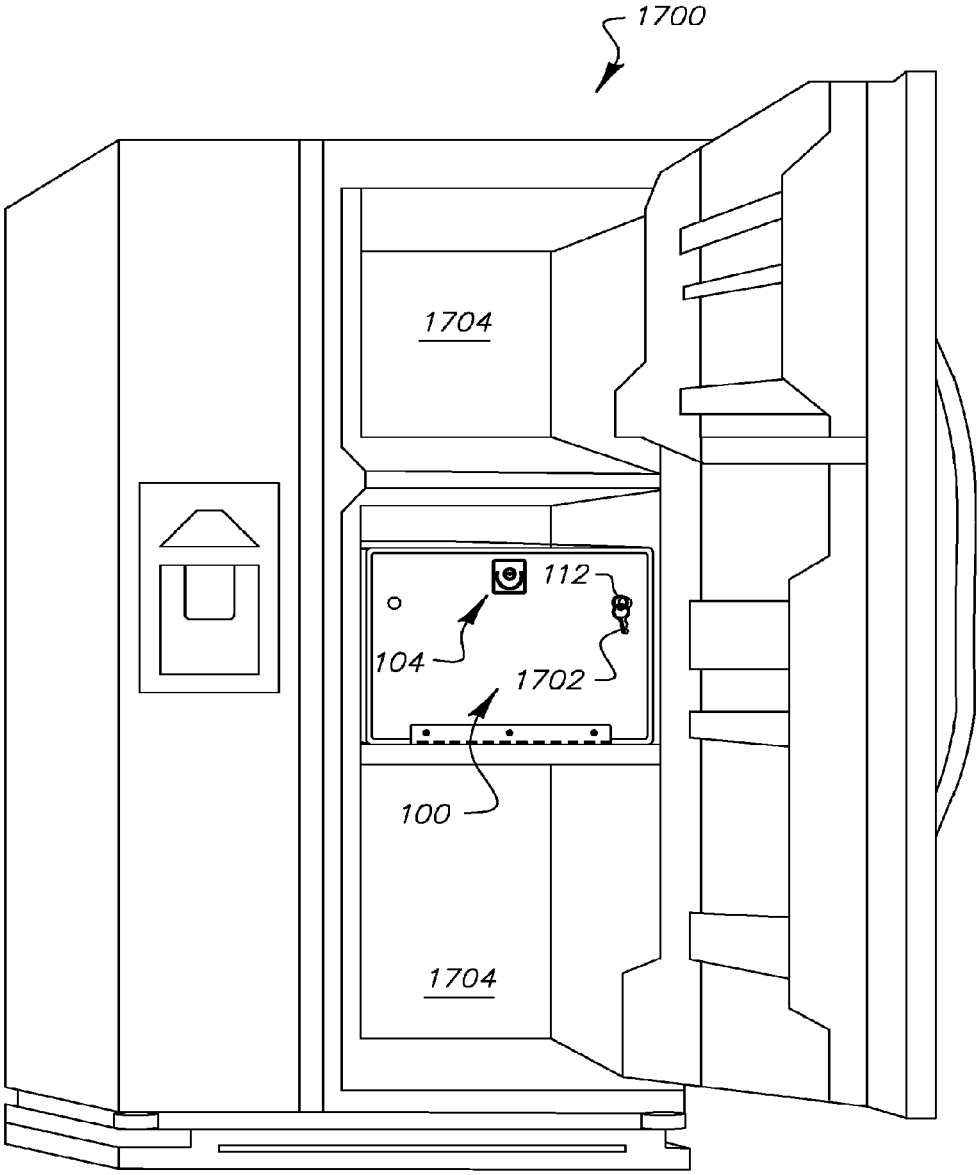
FIG. 17 illustrates perspective front view of a refrigerator appliance with an exemplary portable storage container stored within.

Holding magnet (left side) 110 and holding magnet (right side) 112 both function as convenience accessories for temporarily holding steel key 1702 (as depicted in FIG. 17), or the like magnetic material. Feet 120 are positioned about the four corners of bottom wall 216 to provide a compliant interface between bottom wall 216 and a receiving surface.

Figure 2:
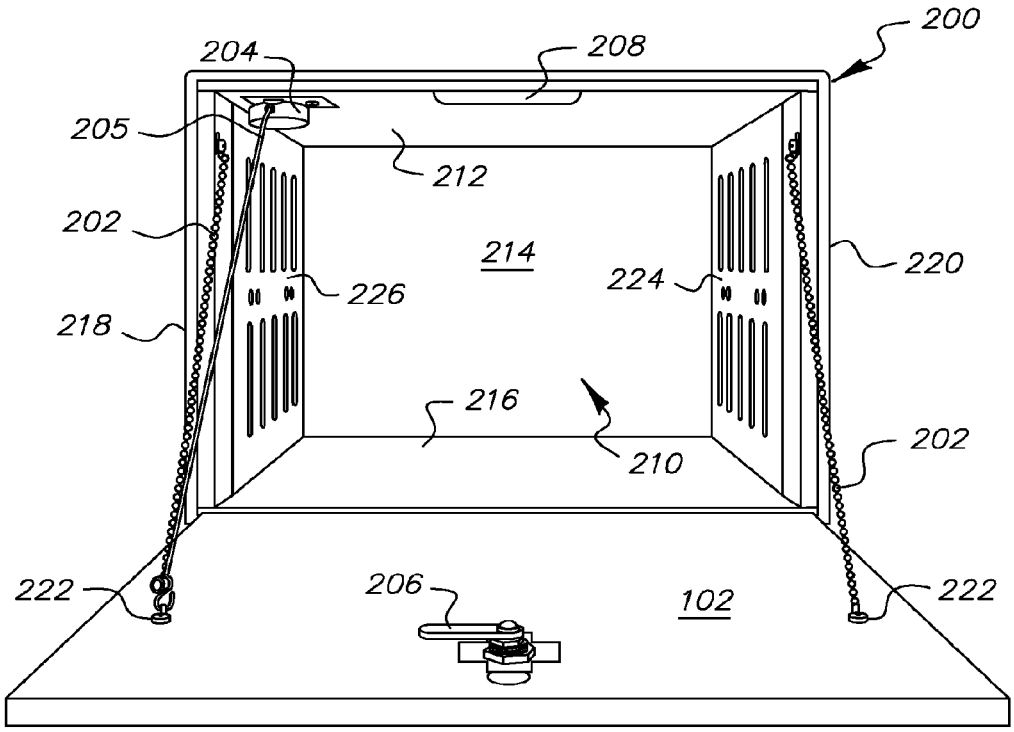
FIG. 2 illustrates a perspective front view of exemplary portable storage container 100 with the hingedly connected door in the open state.

FIG. 2 illustrates open door configuration 200, depicting a perspective front view of exemplary portable storage container 100 with hingedly connected door 102 in the open state. Inner storage volume 210 is configured from the following edgedly connected planar surfaces: door (front wall) 102, top wall 212, back wall 214, bottom wall 216, left side wall 218 (overlaid with left shutter member 226), and right side wall 220 (overlaid with right shutter member 224).

Retractor cable assembly 204 includes retractor cable 205, wherein one end of cable 205 is retractably secured to top wall 212 via cable assembly 204, while the opposing end of cable 205 is fastened to door 102 via door fastener 222. The retracting system provides a means for a controlled opening and/or assisted closing of hingedly connected door 102. More specifically, controlled opening will prevent door 102 from dropping open or slamming, by dampening the opening motion. The pulling force associated with retractor cable 205 on door 102 additionally provides a user with an assisted closing feature. Door travel limiters 202 are two fixed length cords with one of the ends fastened to door 102 via fasteners 222 and opposing ends fastened to the upper-front portion of both left side wall 218 and right side wall 220. Door travel limiters 202 limit the range of motion of door 102 to approximately ninety degrees, which enables door 102 to function as a temporary storage surface or shelf when extended to the open position.

Figure 3:
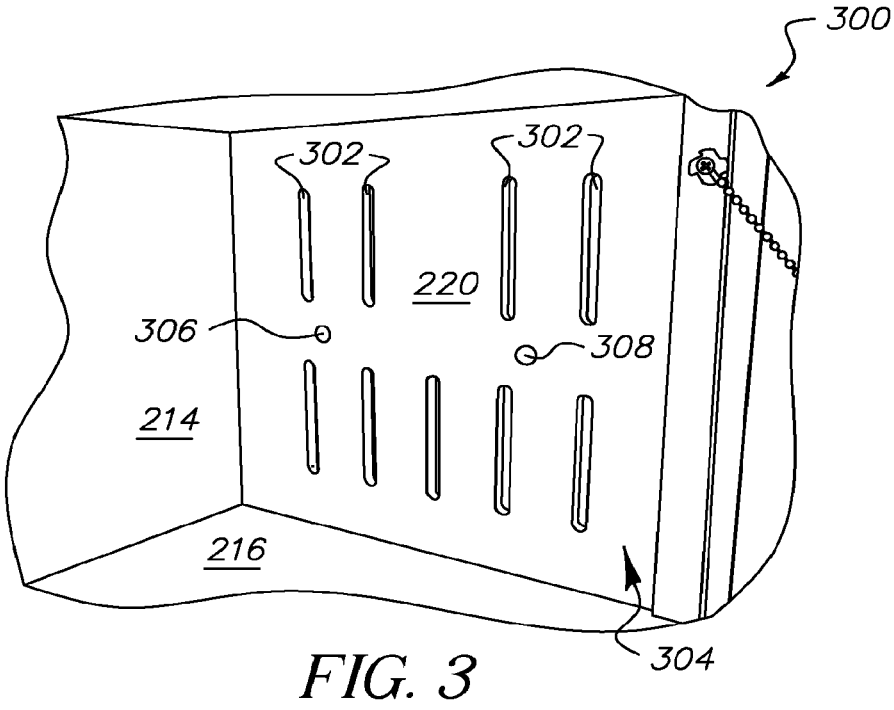
FIG. 3 primarily illustrates a detailed perspective view of the right side wall of the inner storage volume of the portable storage container.

FIG. 3 illustrates storage volume detail 300, depicting a perspective view of the right side wall 220 portion of inner storage volume 210. By way of example, but not limitation, features and functions of right side wall 220 are mirrored on the left side wall 218. Right side wall 220 and right shutter member 224 are component members comprising right wall aperture ventilation assembly 500 (depicted in FIG. 500).

Right side wall 220 possesses wall aperture array 304 comprised of a plurality of wall apertures 302. Wall apertures 302 each possess a wall aperture shape and a wall aperture size. By way of example, but not limitation, the wall aperture shape is configured as an oval slot, wherein the wall aperture size dictates slot parameters such as length, width, open area, and the like. In preferred embodiments, wall apertures 302 are symmetrically disposed about right side wall 220, thereby providing an aesthetically pleasing, functional wall aperture array 304. Fastened onto right side wall 220 are wall magnetic fastening material (rear member) 306 and wall magnetic fastening material (front member) 308, both fastening materials shall be referred to as second magnetic fastening materials.

Figure 4:
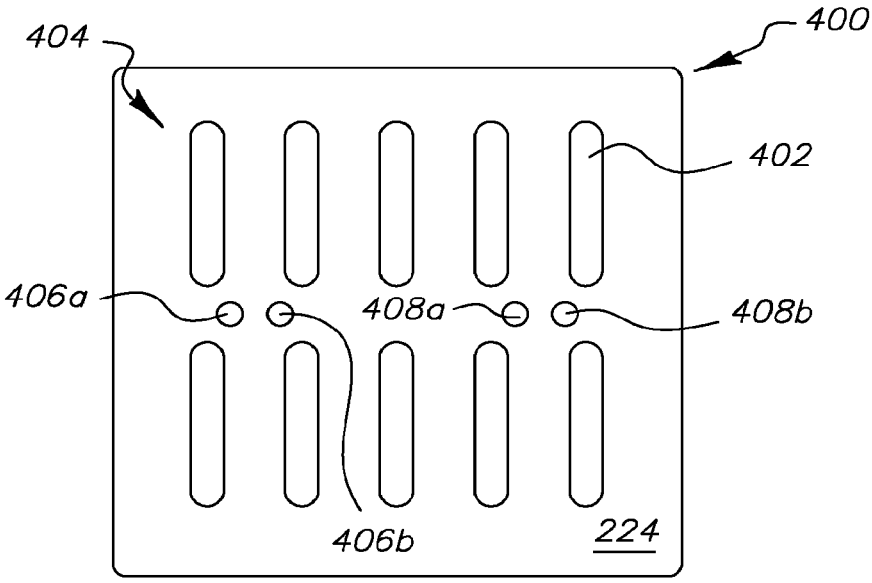
FIG. 4 illustrates an orthogonal front view of right shutter member 400.

FIG. 4 illustrates a front view of right shutter member 400. Right shutter member 400 possesses a right shutter aperture array 404 comprised of a plurality of right shutter apertures 402. Shutter apertures 402 each possess a shutter aperture shape and a shutter aperture size. By way of example, but not limitation, the shutter aperture shape is configured as oval slots, wherein the shutter aperture size dictates slot parameters such as length, width, open area, and the like. In preferred embodiments shutter apertures 402 are symmetrically disposed about right shutter member 224, thereby providing an aesthetically pleasing, functional shutter aperture array 404. Fastened onto right shutter member 224, are shutter magnetic fastening materials 406*a*, 406*b*, 408*a*, and 408*b*; these four fastening materials shall be referred to as first magnetic fastening materials.

Figure 5:
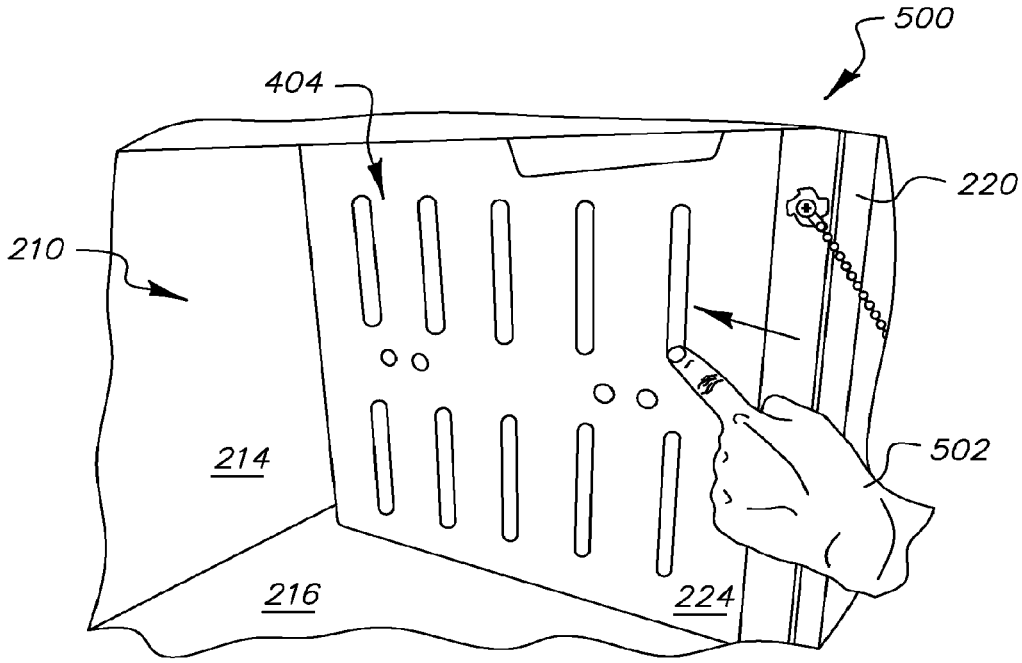
FIG. 5 illustrates an inner storage volume detailed perspective view of right shutter member 224 superjacently engaging right side wall 220. Additionally depicted is a user, adjusting ventilation level by manipulating right shutter member 224.

FIG. 5 illustrates right wall aperture ventilation assembly 500, depicting a detailed perspective view of right shutter member 224 superjacently engaging right side wall 220. Right shutter member 224 and right side wall 220 possess a coordinated sliding relationship with each other. Right shutter member 224 is held onto right side wall 220 by the interactive magnetic forces between the first and second magnetic fastening materials. These magnetic forces (attracting) additionally generate a biasing force urging right shutter member 224 onto right side wall 220 creating frictional engagement that encourages sealing between the two surfaces. Shutter aperture array 404 is substantially identical to wall aperture array 304, both possessing oval slots having the same aperture size, coordinate locations, and so forth, to enable all shutter apertures 402 to align with corresponding wall apertures 302 when shutter aperture array 404 is slid to the open position. With shutter aperture array 404 in the open position, inner storage volume 210 can intake and/or exhaust air to the outside environment or ambient atmosphere. Sliding shutter aperture array 404 to the closed position will misalign all shutter apertures 402 with respect to corresponding wall apertures 302, thereby sealing off inner storage volume 210 from the ambient atmosphere preventing or greatly reducing air intake and/or exhaust. Depicted is user 502 slidingly positioning shutter member 224 from inner storage volume 210.

The biasing force urging right shutter member 224 onto right side wall 220 is a continuous fastening force, present when right side wall 220 is experiencing sliding motion, in addition to static positions. This dynamic fastening system provides an effective means for slidingly holding said shutter member 224 against said wall aperture array 304 located on right side wall 220. Additonally, the dynamic fastening system does not require a slot or rail system to slidingly hold shutter member 224 in place. Therefore shutter member 224 can be easily detached and removed by a user by merely overcoming the magnetic holding forces. Such a configuration enables quick, simple disassembly/assembly to facilitate device cleaning.

Figure 6:
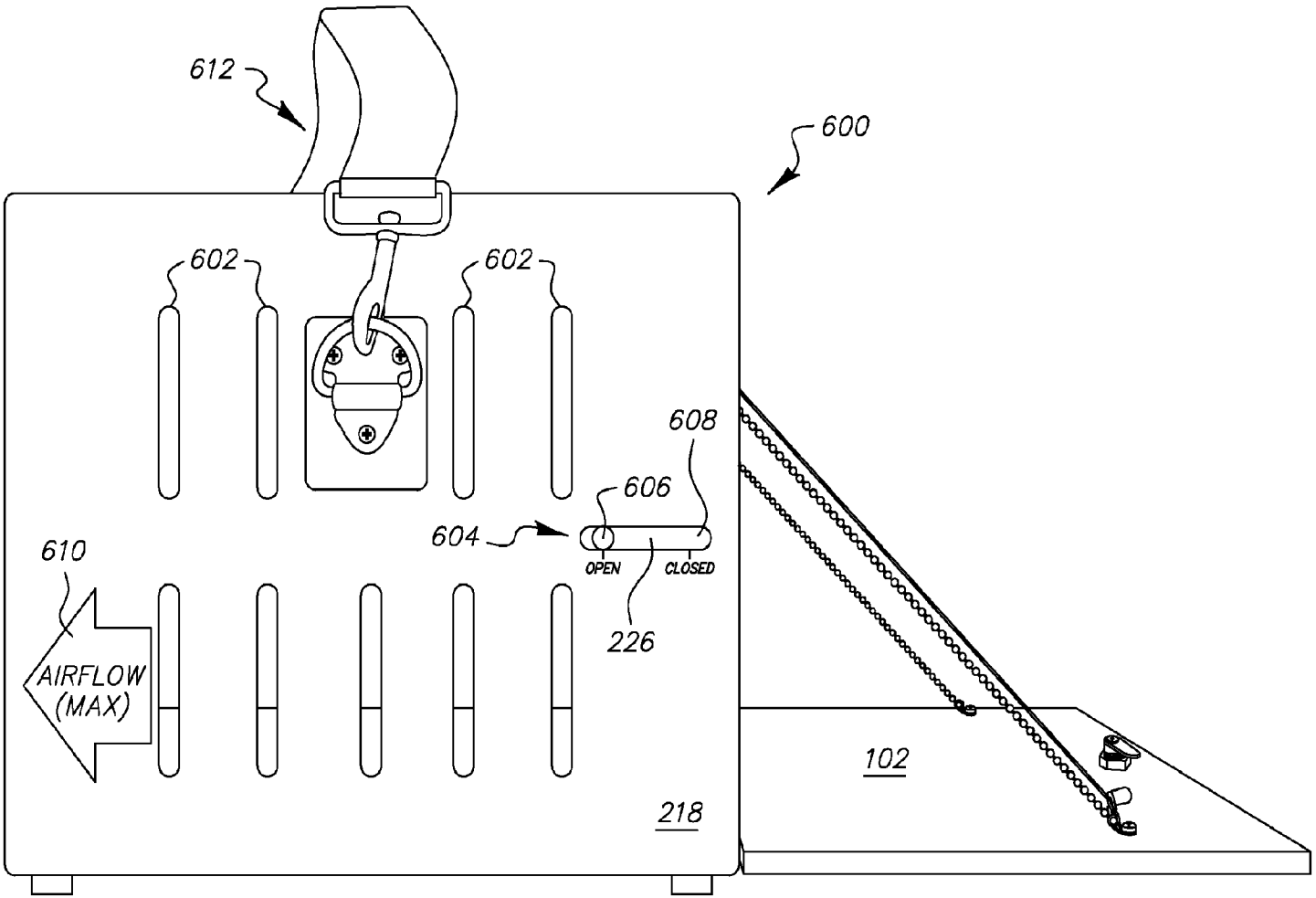
FIG. 6 illustrates an external orthogonal view of left side wall 218 of exemplary portable storage container 100 with the hingedly connected door in the open state. Additionally, depicts an external shutter control assembly selected to the open position.

FIG. 6 illustrates left wall aperture ventilation assembly 600, depicting an external view of left side wall 218. Note that the depicted left wall aperture ventilation assembly 600 is a substantial mirror image of the aforementioned right wall aperture ventilation assembly 500 and associated drawings and explanations, with the exception of the added external shutter control assembly 604 feature. Otherwise, all components comprising right wall aperture ventilation assembly 500 have equivalent left wall aperture ventilation assembly 600 components, which function in like manner; the component relationships, dimensions, and the like, are to be regarded as comparable for the present discussion.

External shutter control assembly 604 provides a means for adjusting left shutter member 226 from the outside of the container. The left shutter member 226 can be adjusted with the container in any state (i.e. door 102 in the open, closed, or closed and locked states). External shutter control assembly 604 includes control knob 606, and control knob slot 608 having an open position located at the far left and an opposing closed position located at the far right. Control knob 606 is securely fastened to left shutter member 226; knob 606 can be positioned by a user along any point between and including the open and closed positions depicted on control knob slot 608. The positioning of control knob 606 along slot 608 determines the amount of airflow 610 permitted through every wall aperture 602 (comprising array of wall apertures 602) simultaneously.

Figure 9:
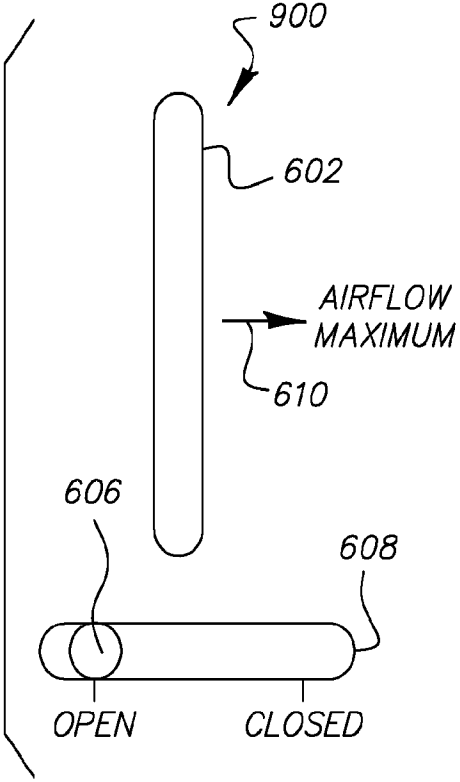
FIG. 9 illustrates a front view detail of FIG. 6 where the external shutter control assembly is disposed in the open position resulting in a fully open ventilation level. No wall aperture 602 blockage results from left shutter member 226.

Left wall aperture ventilation assembly 600 depicts control knob 606 in the open position, resulting in maximum airflow 610 through array of wall apertures 602. A detailed drawing further elaborating on the maximum airflow 610 configuration is depicted in FIG. 9. FIG. 6 additionally depicts shoulder strap assembly 612, which provides a user a convenient means for carrying the container. Shoulder strap assembly 612 is particularly useful when the container is storing heavy items, e.g. liquids. Shoulder strap assembly 612 is configured to be user removable.

Figure 7:
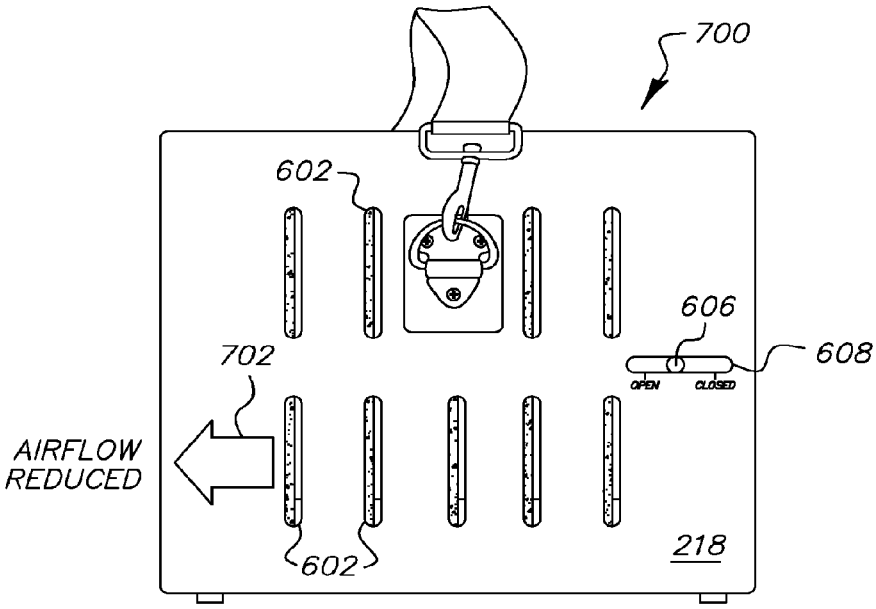
FIG. 7 illustrates an external orthogonal view of left side wall 218 of exemplary portable storage container 100 with the hingedly connected door in the closed state. Additionally, this figure depicts an external shutter control assembly selected to the partially open position.
Figure 10:
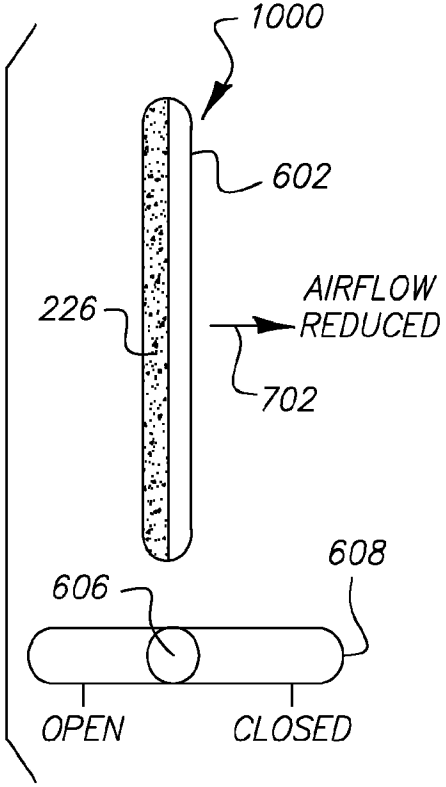
FIG. 10 illustrates an orthogonal front view detail of FIG. 7 where external shutter control assembly is disposed in the partially open position resulting in a partially open ventilation level. Left shutter member 226 is blocking a portion of wall aperture 602.

FIG. 7 illustrates left wall aperture ventilation assembly 700, depicting an external view of left side wall 218. Depicted is control knob 606 positioned mid-way between the open position and a closed positions disposed on control knob slot 608, resulting in a reduced airflow 702 condition. A detailed drawing further elaborating on the reduced airflow 702 configuration is depicted in FIG. 10.

Figure 8:
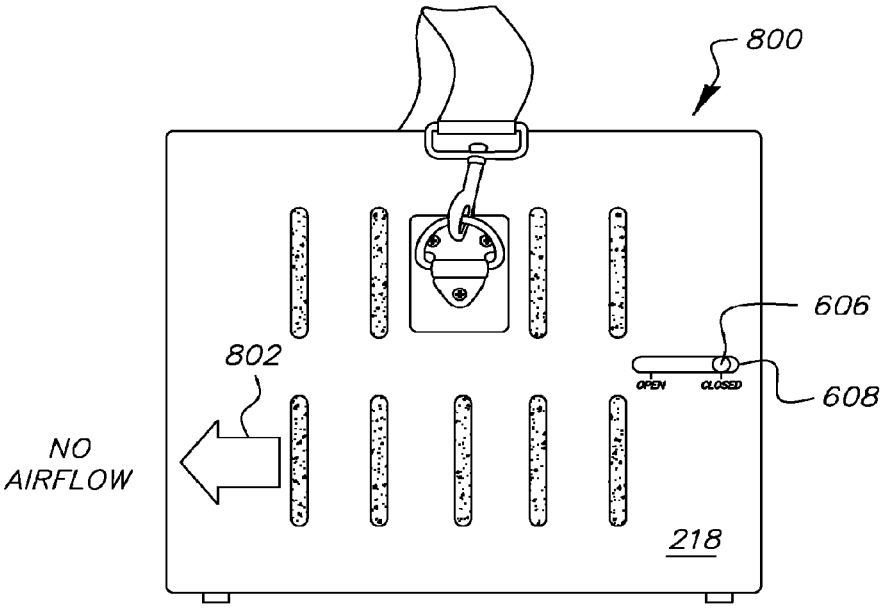
FIG. 8 illustrates an external perspective view of left side wall 218 of exemplary portable storage container 100 with the hingedly connected door in the closed state. Additionally, this figure depicts an external shutter control assembly selected to the closed position.
Figure 11:
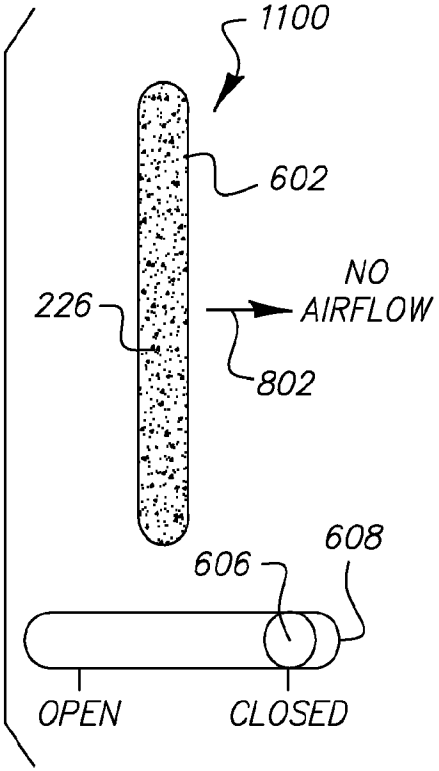
FIG. 11 illustrates an orthogonal front view detail of FIG. 8 where external shutter control assembly is disposed in the closed position resulting in substantially no ventilation. Left shutter member 226 is completely blocking wall aperture 602.

FIG. 8 illustrates left wall aperture ventilation assembly 800, depicting an external view of left side wall 218. Depicted is control knob 606 positioned in the closed position located on the far left portion of control knob slot 608, resulting in a zero or no airflow 802 condition where the inner storage volume is substantially sealed off from the ambient atmosphere. A detailed drawing further elaborating on the no airflow 802 configuration is depicted in FIG. 11.

FIG. 9 illustrates a fully open ventilation level 900. FIG. 9 depicts the ventilation details associated with left wall aperture ventilation assembly 600, depicting control knob 606 in the open position, resulting in maximum airflow 610.

Wall aperture 602 is in full alignment with left shutter aperture (analogous to right shutter aperture 402 of FIG. 4).

FIG. 10 illustrates a partially open ventilation level 1000. FIG. 10 depicts the ventilation details associated with left wall aperture ventilation assembly 700, depicting control knob 606 positioned mid-way between the open position and a closed positions located on control knob slot 608, resulting in a reduced airflow 702 condition. Wall aperture 602 is in partial alignment with left shutter aperture (analogous to right shutter aperture 402 of FIG. 4). Depicted is a portion of left shutter member 226 material blocking wall aperture 602 resulting in reduced airflow.

FIG. 11 illustrates a no (zero) ventilation level 1000 condition. FIG. 11 depicts the ventilation details associated with left wall aperture ventilation assembly 800, depicting control knob 606 positioned to the closed position located on control knob slot 608, resulting in a no (zero) airflow 802 condition. Wall aperture 602 is in complete misalignment with left shutter aperture (analogous to right shutter aperture 402 of FIG. 4). Depicted is a left shutter member 226 material completely blocking wall aperture 602 resulting in a no (zero) airflow 802 condition.

Figure 12:
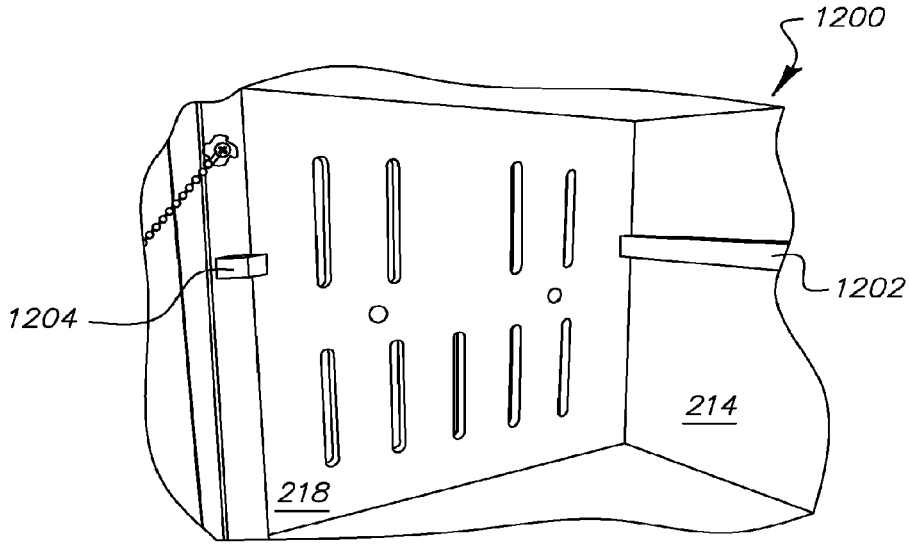
FIG. 12 illustrates a perspective view of the left portion of the inner storage volume, comprising left side wall 218 and back wall 214, further depicting a single shelf support system.

FIG. 12 illustrates storage volume detail 1200, depicting a perspective view of left side wall 218. This container embodiment includes side wall shelf support member 1204 and back wall shelf support member 1202 for supporting a removable shelf so to provide a means for efficiently utilizing the container's inner storage volume.

Figure 13:
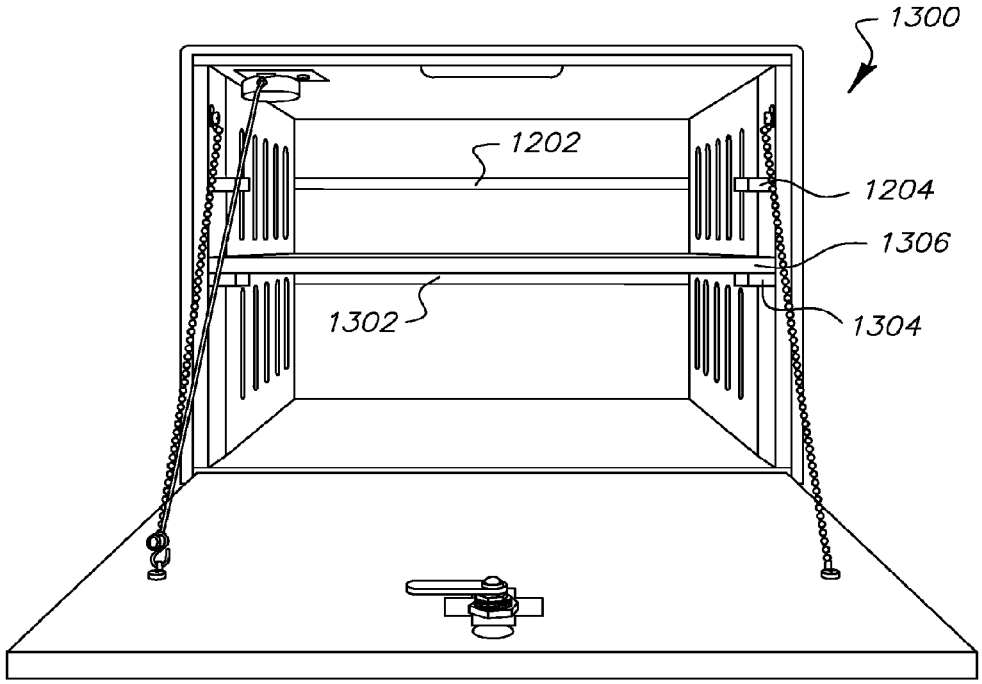
FIG. 13 illustrates a perspective front view of the inner storage volume of exemplary portable storage container 100, further depicting a double shelf support system.

FIG. 13 illustrates inner storage volume double shelf support system 1300, depicting a means for supporting a lower and an upper self. This container embodiment includes side wall shelf support member 1204 and back wall shelf support member 1202 for removably supporting an upper shelf; and side wall shelf support member 1304 and back wall shelf support member 1302 supporting removable lower shelf 1306.

Figure 14:
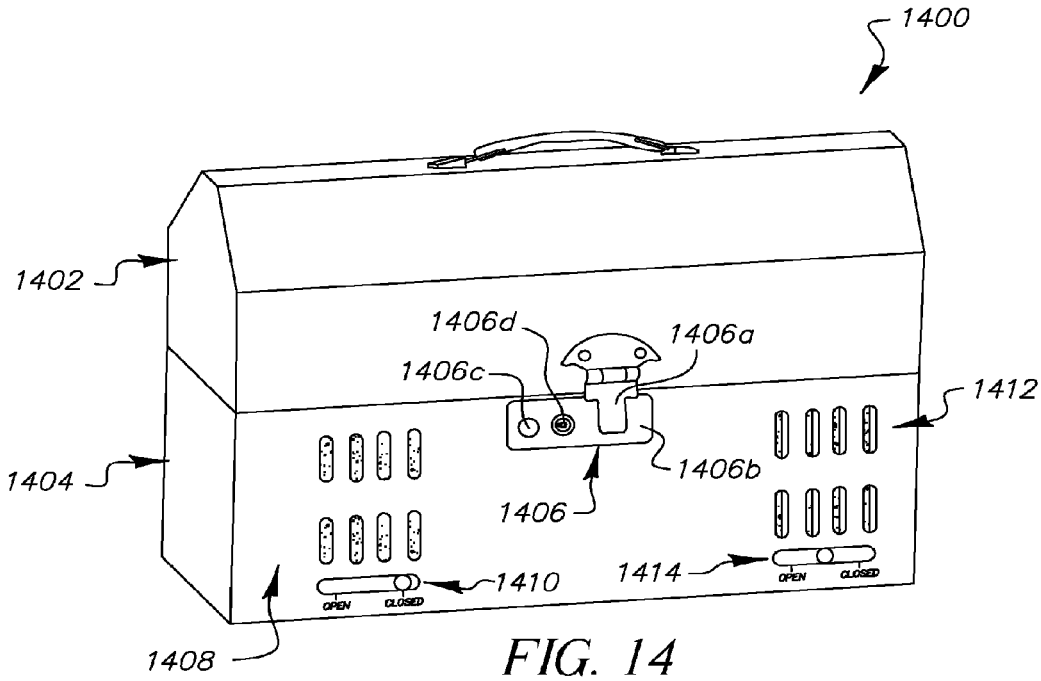
FIG. 14 illustrates a front view of an exemplary multi-compartment portable storage container 1400 with a hingedly connected lid 1402 in the closed state.

FIG. 14 illustrates a multi-compartment portable storage container 1400, comprising a lid 1402 hingedly connected to body 1404, where lid 1402 is in the closed state. Lock assembly 1406, includes latching arm 1406*a*, which is pivotally attached to lid 1402, mating strike plate 1406*b* further comprising latching arm release 1406*c* and key hole 1406*d*. Lock assembly 1406 provides a means for locking lid 1402 to body 1404 to prevent unauthorized access to storage container 1400.

External shutter control assembly 1410 corresponds to left compartment wall aperture array 1408 further depicting a sealed or a no (zero) ventilation level comparably depicted in FIG. 11. External shutter control assembly 1414 corresponds to right compartment wall aperture array 1412 further depicting a sealed or a partially open ventilation level comparably depicted in FIG. 10.

Figure 15:
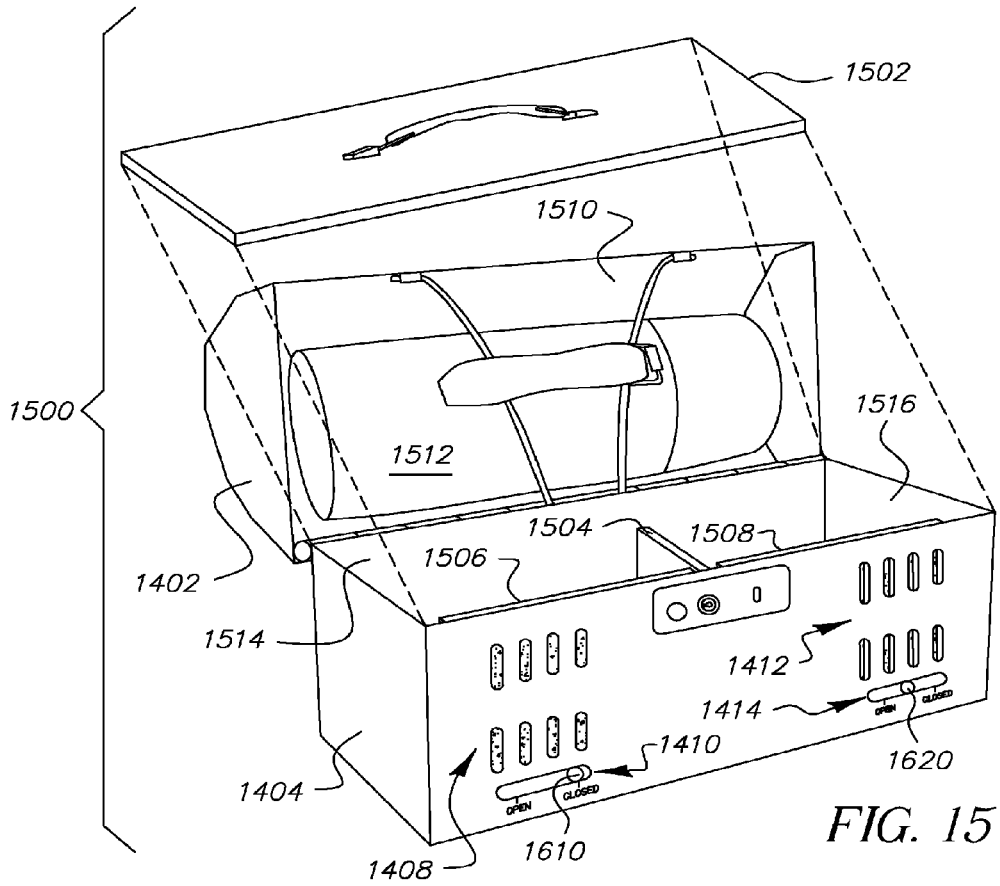
FIG. 15 illustrates a partially exploded front view of an exemplary multi-compartment portable storage container 1400 with a hingedly connected lid 1402 in the open state.

FIG. 15 illustrates a multi-compartment portable storage container 1500, depicting a perspective front view of an exemplary container with lid 1402 hingedly connected to body 1404; where lid 1402 is in the open state. Left compartment inner storage volume 1514 and right compartment inner storage volume 1516 are partitioned by separation wall 1504; in preferred embodiments, separation wall 1504 is configured from a thermally insulative material.

Left compartment inner storage volume 1514 possesses an aperture ventilation assembly that includes a left shutter member 1506 that cooperates with left compartment wall aperture array 1408 to provide a means for adjustable ventilation. Left shutter member 1506 is externally controllable using external shutter control assembly 1410 via control knob 1610. Likewise, right compartment inner storage volume 1516 possesses an aperture ventilation assembly that includes a right shutter member 1508 that cooperates with right compartment wall aperture array 1412 to provide a means for adjustable ventilation. Right shutter member 1508 is externally controllable using external shutter control assembly 1414 via control knob 1620.

In this particular embodiment, lid 1402 includes a lid inner storage volume 1510; for exemplary purposes, thermos 1512 is shown housed in lid inner storage volume 1510. It is understood that other embodiments containing a lid inner storage volume 1510 can include one or more aperture ventilation assemblies.

Removable lid bottom wall 1502 functions as a thermal barrier such that inner storage volumes 1514, 1516, and lid inner storage volume 1510 are thermally isolated from each other when the multi-compartment portable storage container 1500 is in the closed or assembled state as shown in FIG. 14.

Figure 16:
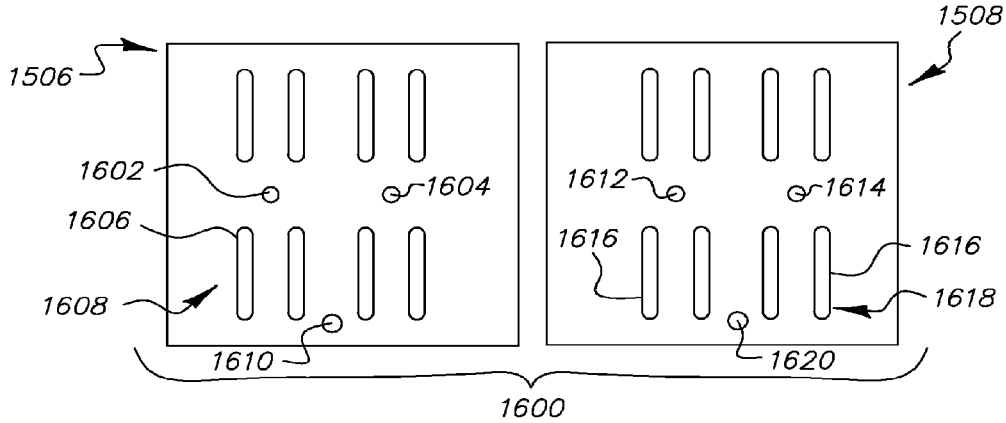
FIG. 16 illustrates orthogonal front views of left shutter member 1510 and right shutter member 1512.

FIG. 16 illustrates a pair of shutter members 1600; comprising left shutter member 1506, right shutter member 1508, used in left compartment inner storage volume 1514 and right compartment inner storage volume 1516, respectively. Left shutter member 1506 includes a plurality of left shutter apertures 1606 that forms a left shutter aperture array 1608 configured to cooperate and function as a shutter with left compartment wall aperture array 1408. Functioning in like manner to aforementioned embodiments, aperture ventilation assemblies include attached magnetic fastening materials 1602, 1604 that are magnetically attracted to corresponding magnetic materials located and fastened within the respective storage compartment; and control knob 1610 provides a means for externally controlling left shutter member 1506. Likewise, right shutter member 1508 includes a plurality of right shutter apertures 1616 that forms a right shutter aperture array 1618 configured to cooperate and function as a shutter with right compartment wall aperture array 1412. Functioning in like manner to aforementioned embodiments, aperture ventilation assemblies include attached magnetic fastening materials 1612, 1614 that are magnetically attracted to corresponding magnetic materials located and fastened within the respective storage compartment; and control knob 1620 provides a means for externally controlling right shutter member 1508.

FIG. 17 illustrates a refrigerator appliance 1700, depicting a portable storage container 100 stored within. Shown is key 1702 (cooperates with lock/handle assembly 104), removably stored on holding magnet 112 for convenience. Refrigerator appliance 1700 provides an example of a controlled ambient atmosphere 1704. Portable storage container 100 containing items that are to be kept cold, e.g. certain medicines, foods, and the like; would have all aperture ventilation assemblies set to the fully open ventilation level (as shown in FIGS. 6 and 9) to permit the cool ambient atmosphere 1704 produced by refrigerator appliance 1700 to freely enter container 100. When portable storage container 100 is removed from refrigerator appliance 1700, the aperture ventilation assemblies on the container should be set to the fully closed ventilation level 1100 (as shown in FIGS. 8 and 11) to maintain the cool ambient atmosphere within, and reduce/prevent stored items from interacting with warm air temperatures found outside of the refrigerator appliance 1700. The process is reversed when container 100 is returned to an appropriate cool ambient atmosphere.

What is claimed is:

1. A portable storage container having a means for manually adjustable ventilation, comprising:

a plurality of walls, wherein said plurality of walls are edgedly engaged thereby forming a closable said portable storage container defining an inner storage volume; and said plurality of walls includes a bottom wall, a top wall, a front wall, a back wall, a right side wall, and a left side wall; and at least one door configured from at least one of said plurality of walls for accessing said inner storage volume; and at least one of said plurality of walls, having a substantially planar portion, wherein said substantially planar portion includes an aperture ventilation assembly thereon for controlling the amount of ventilation between said inner storage volume and an ambient atmosphere surrounding said portable storage container; and said aperture ventilation assembly, comprising a plurality of wall apertures forming a wall aperture array disposed on said substantially planar portion located on said at least one of said plurality of walls, wherein each said wall aperture includes a wall aperture geometry comprising a wall aperture shape and a wall aperture size; and a shutter member having a substantially planar configuration, comprising a plurality of shutter apertures forming a shutter aperture array disposed thereon, wherein each said shutter aperture includes a shutter aperture geometry comprising a shutter aperture shape and a shutter aperture size;

said aperture ventilation assembly comprises a ventilation level, including a closed state and a fully open state, and is further characterized by said shutter member superjacently emplaced over said wall aperture array located inside said inner storage volume, and a system for slidingly holding said shutter member against said wall aperture array, comprising a first magnetic fastening material comprised from at least one magnet, ferrous material, or combination thereof; and a second magnetic fastening material comprised from at least one magnet, ferrous material, or combination thereof;

wherein said first magnetic fastening material is fastened onto said shutter member and said second magnetic fastening material is fastened onto said wall aperture array, such that a linear sliding relationship including a frictional engagement between said shutter member and said wall aperture array such that in said closed state, said inner storage volume is substantially sealed off from said ambient atmosphere.

2. The portable storage container of claim 1, wherein said plurality of walls are substantially fabricated from a thermally insulative, rigid material such that when said portable storage container is in said closed state, said inner storage volume is substantially thermally isolated from said ambient atmosphere.

3. The portable storage container of claim 1, further comprising a hingedly connected door configured from said at least one door hingedly connected to one of said plurality of walls comprising said portable storage container, such that said hingedly connected door possesses an opening direction that swings away from said inner storage volume, thereby providing a means for accessing said inner storage volume.

4. The portable storage container of claim 3, wherein said hingedly connected door possesses a door travel limiter for limiting the range of motion of said hingedly connected door to approximately ninety degrees.

5. The portable storage container of claim 3, wherein said hingedly connected door possesses a retractor cable assembly, wherein said retractor cable assembly provides a means for: assisted closing of said hingedly connected door, a means for controlled opening of said hingedly connected door, or any combination thereof.

6. The portable storage container of claim 3, further comprising a means for locking said hingedly connected door to one of said plurality of walls comprising said portable storage container, so to prevent unauthorized access to said inner storage volume.

7. The portable storage container of claim 1, wherein said wall aperture geometry is substantially similar to said shutter aperture geometry, whereby said wall aperture shape is substantially similar to said shutter aperture shape, and said wall aperture size is substantially similar to said shutter aperture size.

8. The portable storage container of claim 3, wherein said hingedly connected door possesses a retractor cable assembly, wherein said wall aperture geometry is substantially identical to said shutter aperture geometry, such that said wall aperture shape is substantially identical to said shutter aperture shape, and said wall aperture geometry is substantially identical to said shutter aperture geometry.

9. The portable storage container of claim 1, wherein said aperture ventilation assembly further comprises a continuous said linear sliding relationship between said shutter member and said wall aperture array such that a plurality of said ventilation levels are selectable between said closed state and said fully open state.

10. The portable storage container of claim 1, wherein said inner storage volume further comprises at least one shelving member and corresponding means for attaching said at least one shelving member onto said inner storage volume, so to provide a means for efficiently utilizing storage space provided by said inner storage volume.

11. The portable storage container of claim 1, further comprising a means for external control for positioning said shutter member so to enable adjustment of said ventilation level by a user from said ambient atmosphere surrounding said portable storage container.

12. The portable storage container of claim 1, wherein said portable storage container is substantially fabricated from a thermally insulative, rigid material so to provide substantial thermal isolation from said ambient atmosphere.

13. A portable storage container, comprising:

a body, having a bottom wall, a front wall, a back wall, a right side wall, a left side wall, and an open top; wherein all said walls define a body storage volume; and at least one separation wall disposed within said body storage volume such that a plurality of contiguous storage compartments are configured, wherein all said contiguous storage compartments possess a compartment inner volume that is substantially rectilinear comprising a plurality of compartment walls, including a compartment front wall, a compartment back wall, a compartment right side wall, and a compartment left side wall; and a lid, hingedly attached to said body configured to completely engage with said open top so to define a closable said portable storage container;

each of said plurality of contiguous storage compartments comprises at least one of said plurality of compartment walls includes a substantially planar portion, wherein said substantially planar portion includes an aperture ventilation assembly thereon for controlling the amount of ventilation between said compartment inner storage volume and an ambient atmosphere surrounding said portable storage container; and said aperture ventilation assembly, comprising a plurality of wall apertures forming a compartment wall aperture array disposed on said substantially planar portion located on said at least one of said plurality of compartment walls, wherein each said compartment wall aperture includes a compartment wall aperture geometry comprising a compartment wall aperture shape and a compartment wall aperture size; and a shutter member having a substantially planar configuration, comprising a plurality of shutter apertures forming a shutter aperture array disposed thereon, wherein each said shutter aperture includes a shutter aperture geometry comprising a shutter aperture shape and a shutter aperture size;

said aperture ventilation assembly comprises a ventilation level, including a closed state and a fully open state, and is further characterized by said shutter member superjacently emplaced over said compartment wall aperture array located inside said compartment inner storage volume, and a system for slidingly holding said shutter member against said wall aperture array, comprising a first magnetic fastening material comprised from at least one magnet, ferrous material, or combination thereof; and a second fastening material comprised from at least one magnet, ferrous material, or combination thereof; wherein said first magnetic fastening material is fastened onto said shutter member and said second magnetic fastening material is fastened onto said compartment wall aperture array, such that a magnetic attracting force between said shutter member and said compartment wall aperture array provides a linear sliding relationship producing a frictional engagement between said shutter member and said compartment wall aperture array such that in said closed state, said compartment inner storage volume is substantially sealed off from said ambient atmosphere.

14. The portable storage container of claim 13, wherein said lid includes a lid inner storage volume; and a lid bottom wall, removably configured to substantially enclose said lid inner storage volume and concurrently function as a compartment top wall to substantially enclose each of said plurality of contiguous storage compartments of said body.

15. The portable storage container of claim 13, further comprising a means for locking said lid hingedly attached to said body, so to prevent unauthorized access to said body storage volume.

16. The portable storage container of claim 13, wherein said aperture ventilation assembly further comprises a continuous said linear sliding relationship between said shutter member and said compartment wall aperture array such that a plurality of said ventilation level is selectable between said closed state and said fully open state.

17. The portable storage container of claim 13, further comprising a means for external control for positioning said shutter member so to enable adjustment of said ventilation level by a user from said ambient atmosphere surrounding said portable storage container.

18. The portable storage container of claim 13, wherein said compartment wall aperture geometry is substantially similar to said shutter aperture geometry, whereby said compartment wall aperture shape is substantially similar to said shutter aperture shape, and said compartment wall aperture size is substantially similar to said shutter aperture size.

* * * * *